US006036064A

United States Patent [19]

Tawil

[11] Patent Number: 6,036,064

[45] Date of Patent: Mar. 14, 2000

[54] HANGER FOR GARMENTS AND ACCESSORIES

[76] Inventor: Edward Tawil, 13 The Intervale, Roslyn, N.Y. 11576

[21] Appl. No.: 09/190,679

[22] Filed: Nov. 12, 1998

[51] Int. Cl.[7] ..... A47G 25/14

[52] U.S. Cl. ..... 223/88; 223/85

[58] Field of Search ..... 223/85, 92, 87, 223/88, 1

[56] References Cited

U.S. PATENT DOCUMENTS

| | | | |
|---|---|---|---|
| 4,601,417 | 7/1986 | Kunreuther | 223/85 |
| 5,014,957 | 5/1991 | Nichols, Jr. | 223/85 |
| 5,261,580 | 11/1993 | Smith | 223/85 |

*Primary Examiner*—Bibhu Mohanty
*Attorney, Agent, or Firm*—Lackenbach Seigel Marzullo Aronson & Greenspan, P.C.

[57] ABSTRACT

A hanger for garments and accessories includes a garment supporting member which defines a predetermined direction for supporting a garment when the predetermined direction is positioned along a predetermined orientation. An attachment member, typically in the form of a hook, is used for attaching the garment supporting member to a support structure and maintaining the predetermined direction substantially along the predetermined orientation. An accessory attachment device, in the form of an elongate plastic tie having two transverse tabs or stops at the ends, is used for substantially fixedly attaching at least one accessory to at least one of the members. Said accessory attachment device is frangible to normally reliably and permanently secure garment accessory to the hanger until the accessory attachment device is physically compromised. In this manner, an accessory remains substantially permanently attached to the hanger so that it cannot be separated from the hanger without destroying the attachment device and rendering the latter incapable of being re-used.

22 Claims, 1 Drawing Sheet

HANGER FOR GARMENTS AND ACCESSORIES

BACKGROUND OF THE INVENTION

1. Field of the Invention

This invention generally relates to clothing hangers and, more specifically, to a hanger for hanging garments and accessories for the garments.

2. Description of the Prior Art

It has long been the practice of clothing manufacturers to market accessories that are designed to be specifically worn with the garments. However, maintaining the accessories together with the garments until a sale takes place has presented problems. Typically, various forms of hangers that are used to hang garments, such as pants, dresses, skirts, coats, etc., are designed, shaped and configured to optimally support the garment being displayed. Thus, a hanger for an outer coat tends to be larger and sturdier than a hanger for a shirt or a blouse. Skirts, on the other hand, are frequently supported on hangers that have depending metallic or plastic clips that secure the upper edge of the skirt. Regardless of the shape or size of the hanger, displaying accessories designed to be worn with a particular garment has traditionally employed various holding clips on the hangers which are designed to hold or secure the particular accessories. Thus, for example, in U.S. Pat. No. 5,065,916 a garment hanger is disclosed that has molded integral clips. In U.S. Pat. No. 5,123,577 a hanger for garment accessories is disclosed that includes plural retention members and slotted openings. In the '916 patent, various slots are provided in the transverse portion of the hanger, and various integral clips are provided at the ends of the hanger. Both the slots as well as the clips can be used to support accessories for the main item of clothing. However, the hanger appears to be more intended to carry a wide variety of different garments or items of clothing and, therefore, the design renders the hanger more versatile. In the '577 patent, various retention members are disclosed, each of which can support various accessories. However, in both of the aforementioned patents, the retention members retain the garment or accessory, at best, by means of pressure or clamping forces that can be readily overcome so that the accessories can be intentionally or inadvertently separated from the garment. Because the accessories can be readily removed and reinstated on the hanger, purchasers may remove such accessories to try them on with the garment and fail to replace the accessories. Also because the clips or clamps used on such hangers operate by pressure or clamping forces, such accessories can also be inadvertently pulled off during handling or transport.

The problem of maintaining two associated or related items on a hanger is exemplified, for example, in connection with matching items, which are not necessarily accessories. Thus, for example, when a multiple-piece man's or woman's suit is sold a serious problem has existed to keep the matching items of the same garment together on the same hanger. Thus, customers frequently try on such garments and do not always replace all of the matching pieces of a multiple piece garment on the same hanger from which they were removed. One approach that has been used to minimize this problem has been to tag each item of the garment with the same or identifying code so that the associated pieces of each garment can be maintained on each hanger and sold together as a unit. Bar codes have been used for this purpose to identify matching pieces that belong together on the same hanger. This approach, however, is not always practical or cost justified in connection with small accessories such as scarves, gloves, hair accessories, etc. Prior art hangers have not been effective in preventing customers from removing or separating primarily smaller accessories from their associated garments. Such separation of accessories can result in their loss and diminish the value of the garment being sold.

In some cases the accessories have been attached directly to the garment by means of a small elongate plastic tie provided with transverse tabs at the ends thereof. The garment and accessory are pierced to position the tie on one side and the tab on the other side of the pierced material. However, this has presented problems. First, excessive pulling forces in the accessory or tie may tear or create a significant hole in the material of the garment. Also, because the garment and the accessory are "permanently" attached by the tie it is impossible to try on the garment alone without the accessory. Because the position where the accessory is attached to the garment is relatively arbitrary and frequently selected as a matter of convenience, a purchaser trying on the garment is relegated to viewing the garment with the accessory hanging from it, which may be unflattering to the garment and undesirable from the standpoint of the customer.

SUMMARY OF THE INVENTION

Accordingly, it is an object of the present invention to provide a hanger for garments and accessories that does not include the disadvantages inherent in such prior art hangers.

It is another object of the present invention to provide a hanger for garments and accessories that is simple and inexpensive to manufacture.

It is still another object of the present invention to provide a hanger for garments and accessories that is simple and convenient to use.

It is yet another object of the present invention to provide a hanger for garments and accessories that prevents accessories from being inadvertently or intentionally removed from the hangers for the associated garments until a sale has been effected.

It is a further object of the present invention to provide a hanger for garments and accessories that substantially permanently attaches an accessory to the hanger so that it cannot be readily separated from the hanger without destroying the fastener.

It is yet a further object of the present invention to provide a hanger for garments and accessories therefor that can be used with all styles of hangers currently used to support and display all varieties and styles of clothing.

It is yet a further object of the present invention to provide a hanger for garments and accessories that can be used to support and display one or more accessories for a given garment.

It is an additional object of the present invention to provide a hanger for garments and accessories as in the previous objects that can be made as a disposable single use hanger or as a hanger that can be re-used after the garment and accessory are removed therefrom.

It is yet an additional object of the present invention to provide a hanger for garments and accessories as in the previous objects that can be adapted to position accessories beneath or over the garment(s) supported on the hanger.

In order to achieve the above objects, as well as others which will become evident hereinafter, a hanger for garments and accessories in accordance with the present invention comprises a garment supporting member defining a predetermined direction for supporting a garment when said predetermined direction is positioned along a predetermined orientation. An attachment member is provided for attaching said garment supporting member to a support structure and maintaining said predetermined direction substantially along said predetermined orientation. Accessory attachment means is provided for substantially fixedly attaching at least one accessory to at least one of said members, said attachment means being frangible to normally reliably secure a garment accessory to the hanger until said attachment means is physically compromised. In this manner, an accessory remains substantially permanently attached to the hanger so that it cannot be separated from the hanger without destroying said attachment means and rendering the latter incapable of being re-used.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which.

DESCRIPTION OF THE PREFERRED EMBODIMENTS

Figure 1:
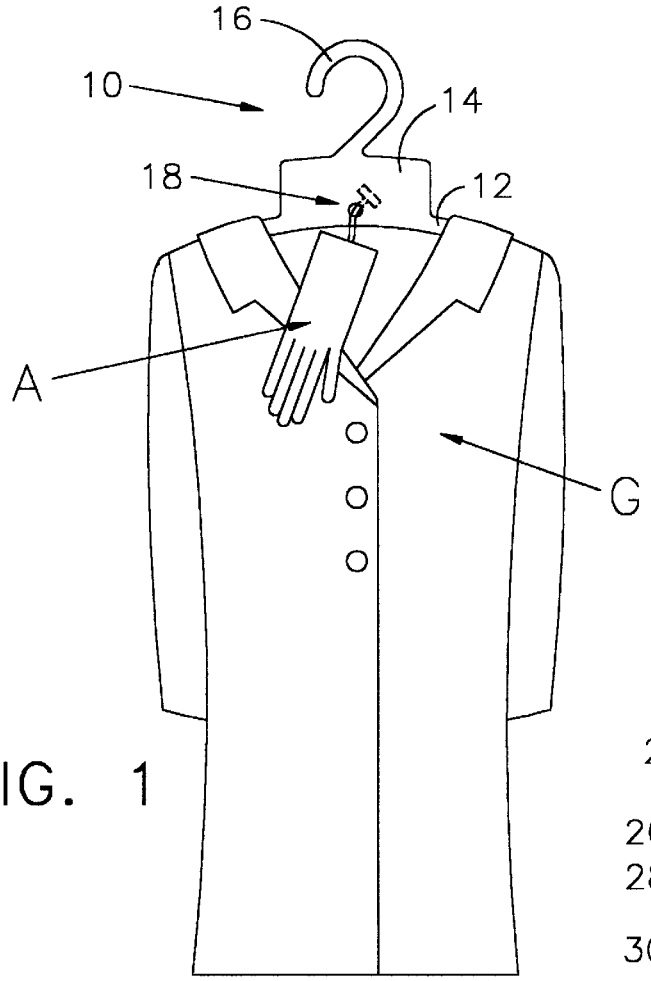
FIG. 1 is a front elevational view of a hanger in accordance with the present invention, shown supporting both a garment and an accessory, in the form of gloves, intended to be worn with the garment.

Referring now specifically to the Figs., in which identical or similar parts are designated by the same reference numerals throughout, and first referring to FIG. 1, a hanger for garments G and accessories A in accordance with the present invention is generally designated by the reference numeral 10.

Figure 2:
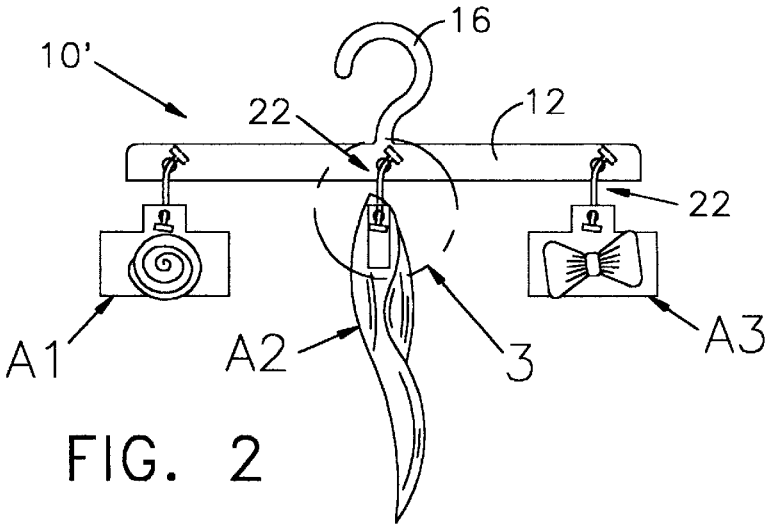
FIG. 2 is a front elevational view of an alternate embodiment of the hanger in accordance with the present invention, showing the manner in which three separate accessories can be supported on the hanger.

The hanger 10 includes a garment supporting member 12 which is generally an elongate member dimensioned for supporting a garment and defining a predetermined direction. The garment supporting member 12 is traditionally arcuate, as suggested in FIG. 1, or straight, as shown in FIG. 2. However, the present invention contemplates such garment supporting member 12 being of any desired configuration to support any garment G sold with accessories, such as suits, pants, skirts, dresses, jackets, outer coats, and the like. Typically, such garment supporting member 12 supports the garment G when it is in a generally horizontal direction. However, while this is typical with most garment hangers, it is not critical for the present invention and the orientation of the hanger in any predetermined direction for supporting a garment may be used. Thus, for example, the garment supporting member may, in fact, be oriented in a vertical direction, as commonly used for ties.

In FIG. 1, the garment supporting member includes an enlarged central planar portion 14. However, while such portion 14 may be conveniently used with the present invention, as will become evident, the use of such portion is not critical.

An attachment member is provided for attaching the garment supporting member 12 to a support structure and maintaining the predetermined direction of the garment supporting member substantially along the desired predetermined orientation. In the embodiments illustrated in FIGS. 1 and 2, such attachment member is in the form of a hook 16 that maintains the garment supporting member in a substantially horizontal orientation. The hook 16, in the illustrations shown in the Figs., is integrally formed with the garment supporting member 12. However, this is not critical, and the hook 16 may be, for example, a metal hook that is secured in conventional ways to the garment supporting member. In fact, the attachment member 16 need not be in the form of a hook but may assume any shape or configuration to support the garment supporting member on an external support structure, such as a rod of a clothing rack. Thus, the attachment member may, instead of a hook, be in the form of a clamp, a ball, to be secured within an associated socket, etc.

An important feature of the present invention is the provision of an accessory attachment mechanism for substantially fixedly attaching at least one accessory A to at least one of the members 12, 16. Such accessory attachment mechanism is generally designated by the reference numeral 18. An important feature of the present invention is that the attachment mechanism used be frangible to normally reliably secure a garment accessory A to the hanger 10 (FIG. 1) or 10' (FIG. 2) until the attachment mechanism is physically compromised or destroyed. The accessory attachment mechanism, therefore, renders it more difficult to separate an accessory and certainly discourages customers or potential customers from removing the accessories since this would necessarily entail the destruction of the attachment device used to secure the accessory to the hanger.

The accessory attachment member or device may be attached to any part of the hanger, including the garment supporting member 12 or the hook 16. For reasons to be described below, the accessory attachment device may be conveniently secured to the central planar portion 14 shown in FIG. 1.

Figure 3:
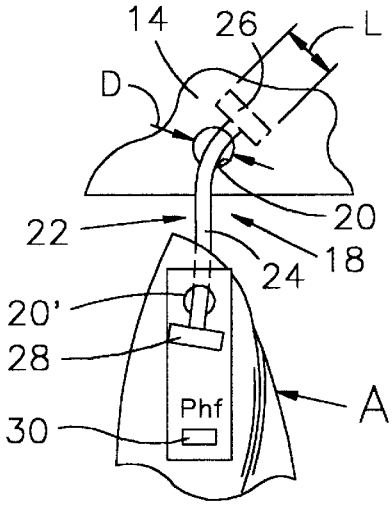
FIG. 3 is an enlarged fragmented view of a portion of the hanger shown in FIG. 2, enlarging the region "3" in FIG. 2.

One specific example of an accessory attachment device is illustrated in the Figs. Referring to FIG. 3, such device 18 being used in conjunction with a hole 20 formed in the hanger and having a diameter D. The device is in the nature of a plastic tie 22 of the type frequently used to secure labels or hang tags to garments or clothing. The tie 22 includes an elongate filament 24 typically formed of plastic. Both the plastic material as well as the diameter of the filament 24 are selected to make the filament relative strong but capable of being severed if sufficiently high tension forces are applied to the ends thereof As indicated, one end of the filament 24 extends through the hole 20 and includes a transverse stop in the form of a transverse tab 26 that has a length L greater than the diameter D of the hole 20 so that the tab 26 cannot normally be passed through the hole 20. Specialized dispensing tools are used for introducing the tabbed ends of the tie through holes or fabrics. Since the method of application of such ties is well known in the clothing art, it will not be discussed in detail.

The other end of the filament 24 is, similarly, introduced through the accessory A as well an optional hang tag 30 that is likewise provided with a hole 20'. Once the tie is secured both to the hanger as well as to the accessory A, it will be evident that the accessory will remain substantially permanently attached to the hanger so that it cannot be separated from the hanger without destroying the tie and rendering the tie incapable of being re-used. By selecting the relative dimensions of D, L and the strength of the filament 24 the accessory attachment device can be made to make it more difficult or easier to be permanently attached or removed from the hanger. This may, to some extent, be a function of the nature of the accessory being used since excessive forces may damage the accessory when it is sought to be removed or separated from the hanger.

As suggested in FIG. 2, a plurality of accessory attachment devices 22 may be provided, three being shown in FIG. 2. Although not critical, the attachment devices 22, when more than one is provided, are preferably substantially uniformly spaced from each other along the predetermined direction or along the garment supporting member 12. However, irrespective of the uniformity of the spacing, the attachment devices 22 are preferably attached to the members 12, 16 at locations that preferably compensate for the weight of the accessories supported on the hanger to maintain the garment supporting member 12 in the predetermined or desired orientation.

As suggested, the hole 20 may be formed anywhere on the hanger. However, an enlarged central planar portion 14, shown in FIG. 1, is particularly suitable as the portion 14 also emphasizes or draws attention to the accessory A. The planar portion 14 also provides an enlarged surface area that can be used to provide advertising text or describe or highlight the accessories being attached.

Also, since the accessory attachment member is intended to be frangible and be capable of only a single use, the present invention also contemplates that the accessory attachment device 22 may be integrally connected to one of the members 12, 14. Thus, instead of providing a transverse tab or stop 26 in FIG. 3 that respective end of the filament 24 may be integrally formed with the hanger portion 14 in which case, of course, a hole 20 would not be needed or used.

As best suggested in FIG. 1, the length of the filament 24 is preferably sufficiency long so that the accessory A can be placed either beneath the garment G or displayed above or over the garment as shown in FIG. 1. As such, the length of the filament 24 is preferably greater than the length L of the tabs or stops 26, 28. In fact, the length of the filament 24 should be a multiple of the length L, preferably exceeding 5. As such, the length of the filament 24 will preferably exceed one inch and for most applications exceed two inches in length. This both prevents accidental severance of the filaments 24 as well as provides the retailer with options in the manner of displaying the accessories A.

While this invention has been described in detail with particular reference to a preferred embodiment thereof, it will be understood that variations and modifications will be effected within the spirit and scope of the invention as described herein and as defined in the appended claims.

What I claim is:

1. A hanger in combination with a garment and at least one garment accessory comprising a garment supporting member defining a predetermined direction for supporting the garment when said predetermined direction is positioned along a predetermined orientation; an attachment member for attaching said garment supporting member to a support structure and maintaining said predetermined direction substantially along said predetermined orientation; and accessory attachment means for substantially fixedly attaching said at least one accessory to at least one of said members, said accessory attachment means being frangible to normally reliably and permanently secure a garment accessory to the hanger until said accessory attachment means is physically compromised, whereby an accessory remains substantially permanently attached to the hanger so that it cannot be separated from the hanger without destroying said attachment means and rendering the latter incapable of being reused.

2. A hanger as defined in claim 1, wherein said attachment member comprises a hook for hanging the hanger as a rod.

3. A hanger as defined in claim 1, wherein said accessory attachment means comprises a frangible tie secured to one of said members of the hanger and to an accessory.

4. A hanger as defined in claim 3, wherein said tie is in the form of a plastic filament.

5. A hanger as defined in claim 4, wherein a hole is provided in one of said members and said tie has one end initially extending through said hole, a transverse stop between attached to that end of said tie that extends through said hole.

6. A hanger as defined in claim 5, wherein said stop comprises a transverse tab having a length greater than the diameter of said hole.

7. A hanger as defined in claim 1, wherein a plurality of accessory attachment means is provided.

8. A hanger as defined in claim 7, wherein three accessory attachment means are provided.

9. A hanger as defined in claim 8, wherein said three attachment means are substantially uniformly spaced from each other along said predetermined direction.

10. A hanger as defined in claim 1, wherein said accessory attachment means is integrally connected to one of said members.

11. A hanger as defined in claim 1, comprising an enlarged central planar portion forming part of garment supporting member, said accessory attachment means being attached to said central planar portion.

12. A hanger as defined in claim 1, wherein at least said garment supporting member is formed of plastic.

13. A hanger as defined in claim 1, wherein both said members are formed of plastic.

14. A hanger as defined in claim 1, wherein both said members are integrally formed.

15. A hanger as defined in claim 6, wherein said length of said tie is greater than the length of said tab.

16. A hanger as defined in claim 15, wherein said length of said tie is a multiple of said length of said tab.

17. A hanger as defined in claim 16, wherein said multiple exceeds 5.

18. A hanger as defined in claim 4, wherein the length of said tie exceeds one inch.

19. A hanger as defined in claim 18, wherein the length of said tie exceeds two inches.

20. A hanger as defined in claim 1, wherein said attachment means is attached to at least one of said members at locations to distribute the weight of said accessories supported on the hanger to maintain said predetermined orientation.

21. A hanger for garments and at least one accessory having a width less than the width of the garment comprising a garment supporting member defining a predetermined direction for supporting a garment when said predetermined direction is positioned along a predetermined orientation and having a width substantially corresponding to a width of a garment to be supported; an attachment member for attaching said garment supporting member to a support structure and maintaining said predetermined direction substantially along said predetermined orientation; and accessory attachment means for substantially fixedly attaching said at least one accessory, having a width less than the width of the garment, to at least one of said members, said accessory attachment means being frangible to normally reliably and permanently secure a garment accessory to the hanger until said accessory attachment means is physically compromised, whereby an accessory remains substantially permanently attached to the hanger so that it cannot be separated from the hanger without destroying said attachment means and rendering the latter incapable of being reused.

22. A hanger for garments and at least one accessory comprising a garment supporting member defining a predetermined direction for supporting a garment when said predetermined direction is positioned along a predetermined orientation and having to lateral ends for engaging and supporting a garment; an attachment member for attaching said garment supporting member to a support structure and maintaining said predetermined direction substantially along said predetermined orientation; and accessory attachment means for substantially fixedly attaching said at least one accessory to at least one of said members at at least one position intermediate to said two lateral ends, said accessory attachment means being frangible to normally reliably and permanently secure a garment accessory to the hanger until said accessory attachment means is physically compromised, whereby an accessory remains substantially permanently attached to the hanger so that it cannot be separated from the hanger without destroying said attachment means and rendering the latter incapable of being reused.

* * * * *